US009263199B2

(12) United States Patent
Reuber et al.

(10) Patent No.: US 9,263,199 B2
(45) Date of Patent: Feb. 16, 2016

(54) ELECTRICAL CONTACT ARRANGEMENT AND AIR INSULATED MEDIUM VOLTAGE CIRCUIT BREAKER INCLUDING THE ELECTRICAL CONTACT ARRANGEMENT

(71) Applicant: ABB Technology AG, Zürich (CH)

(72) Inventors: Christian Reuber, Willich (DE); Dietmar Gentsch, Ratingen (DE)

(73) Assignee: ABB TECHNOLOGY AG, Zürich (CH)

( * ) Notice: Subject to any disclaimer, the term of this patent is extended or adjusted under 35 U.S.C. 154(b) by 30 days.

(21) Appl. No.: 13/766,389

(22) Filed: Feb. 13, 2013

(65) Prior Publication Data

US 2013/0146433 A1 Jun. 13, 2013

Related U.S. Application Data

(63) Continuation of application No. PCT/EP2011/004058, filed on Aug. 12, 2011.

(30) Foreign Application Priority Data

Aug. 13, 2010 (EP) ..... 10008456

(51) Int. Cl.

| | |
|---|---|
| ***H01H 31/02*** | (2006.01) |
| ***H01H 1/14*** | (2006.01) |
| ***H01H 1/38*** | (2006.01) |
| *H01H 1/44* | (2006.01) |

(Continued)

(52) U.S. Cl.

CPC ..... *H01H 1/14* (2013.01); *H01H 1/385* (2013.01); *H01H 1/44* (2013.01); *H01H 33/12* (2013.01)

(58) Field of Classification Search

USPC ..... 200/48 R, 275, 279; 218/30, 48, 123; 439/252

See application file for complete search history.

(56) References Cited

U.S. PATENT DOCUMENTS 2,176,718 A * 10/1939 Linde ..... 439/252
4,371,765 A 2/1983 Ragaller (Continued)

FOREIGN PATENT DOCUMENTS

| | | |
|---|---|---|
| DE | 41 05 335 A1 | 8/1992 |
| DE | 196 48 633 A1 | 5/1998 |
| FR | 2 478 866 A1 | 9/1981 |

OTHER PUBLICATIONS

International Search Report (PCT/ISA/210) issued on Nov. 17, 2011, by the European Patent Office as the International Searching Authority for International Application No. PCT/EP2011/004058.

(Continued)

*Primary Examiner* — Vanessa Girardi

(74) *Attorney, Agent, or Firm* — Buchanan Ingersoll & Rooney PC

(57) ABSTRACT

An electrical contact arrangement for medium to high voltage applications includes a contact arm having a distal end section on which a circular shaped annulus arrangement having several axially and parallel directed contact fingers is arranged. The contact fingers are pressed on the contact arm via respective radially directed connection sections by a spring ring which is peripherally arranged around the contact fingers. The distal end section of the contact arm includes a first ring-shaped surface and an adjacent second ring-shaped surface, so that the connection section of each contact finger is pressed to at least both the first and second ring-shaped surfaces.

17 Claims, 2 Drawing Sheets

(51) Int. Cl.
*H01H 33/12* (2006.01)

(56) References Cited

U.S. PATENT DOCUMENTS 5,869,796 A * 2/1999 Matsuda et al. ..... 218/48
5,981,893 A 11/1999 Bleiker et al.

OTHER PUBLICATIONS

Written Opinion (PCT/ISA/237) issued on Nov. 17, 2011, by the European Patent Office as the International Searching Authority for International Application No. PCT/EP2011/004058.
European Search Report for EP 10008456 dated Jan. 4, 2011.

* cited by examiner

ELECTRICAL CONTACT ARRANGEMENT AND AIR INSULATED MEDIUM VOLTAGE CIRCUIT BREAKER INCLUDING THE ELECTRICAL CONTACT ARRANGEMENT

RELATED APPLICATIONS

This application claims priority as a continuation application under 35 U.S.C. §120 to PCT/EP2011/004058, which was filed as an International Application on Aug. 12, 2011 designating the U.S., and which claims priority to European Application 10008456.5 filed in Europe on Aug. 13, 2010. The entire contents of these applications are hereby incorporated by reference in their entireties.

FIELD

The present disclosure relates to an electrical contact arrangement for medium to high voltage applications.

BACKGROUND INFORMATION

Medium voltage circuit breakers interrupt the current by creating and extinguishing the arc in a vacuum container. Vacuum circuit breakers tend to have a longer life expectancy than air or $SF_6$ circuit-breakers. Vacuum circuit breakers replaced air and $SF_6$ circuit breakers at least for indoor applications. However, the present disclosure is directed to all kinds of circuit breakers in the range of medium voltage to high voltage applications, including for electrical connectors in air insulated medium voltage switch gear panels. Such switch gear panels include means or contact systems to connect and disconnect the electrical circuit to busbar terminals and cable terminals of the panel when they are being inserted and removed, respectively. Therefore, special electrical contact arrangements are provided having several contact fingers forming a circular crown-shaped arrangement for electrically connecting a distal end section of a contact arm to the busbar terminal in the panel.

DE 196 48 633 A1 discloses an electrical contact arrangement for high voltage applications including an annulus arrangement having several axially and parallel directed contact fingers which are separated one to another by intermediate slits. The contact fingers are designed as respective sections of a one-piece sleeve part, which is mechanically and electrically connected to the distal end of a contact arm.

According to other known embodiments of electrical contact arrangements, the contact fingers are designed as single pieces. For a sufficient electromechanical contact to the contact arm, these single fingers are pressed with a surrounding spring ring onto a ring-shaped surface on the distal end section of the contact arm. Since the single contact fingers also have to be pressed onto the terminal in the panel, the same spring ring also acts in the axial direction. Therefore, each contact finger is angled. There may be additional means for supporting the structure of the contact fingers and the ring spring in order to form a mechanically stable but elastic electrical contact arrangement. The pressing of the contact fingers onto the contact arm by the ring spring is important both to reduce the electrical resistance for passing the temperature rise typetest, and to obtain the required mechanical stability to pass the short time withstand current typetest.

It is known that only the ring-shaped surface on the end section of the contact arm comes in contact with the corresponding section of the contact fingers.

SUMMARY

An exemplary embodiment of the present disclosure provides an electrical contact arrangement for medium to high voltage applications. The exemplary electrical contact arrangement includes a contact arm having a distal end section, and a circular shaped annulus arrangement arranged on the distal end section of the contact arm. The annulus arrangement includes a plurality of axially and parallel directed contact fingers. In addition, the exemplary electrical contact arrangement includes a plurality of radially directed connection sections arranged to press a corresponding one of the plurality of contact fingers on the contact arm by a first spring ring which is peripherally arranged around the contact fingers. The distal end section of the contact arm includes a first ring-shaped surface and an adjacent second ring-shaped surface. The corresponding connection section of each contact finger is respectively pressed to both the first and second ring-shaped surfaces.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
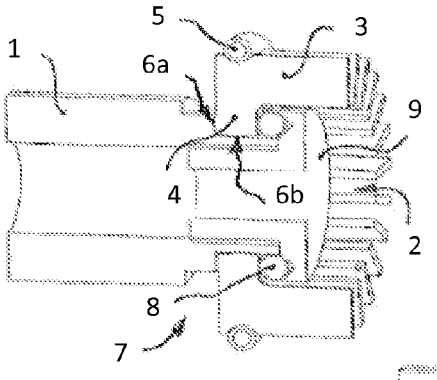
FIG. 1 is a perspective side view of an exemplary embodiment of an electrical contact arrangement of the present disclosure in a L-groove version.

Exemplary embodiments of the present disclosure provide an electrical contact arrangement using a circular-shaped annulus arrangement which includes several (e.g., a plurality of) axially and parallel directed contact fingers having an increased mechanically stability without influences on the required resilience of the single contact fingers.

According to an exemplary embodiment of the present disclosure, the distal end section of the contact arm includes a first ring-shaped surface and an adjacent second ring-shaped surface, wherein the connection section of each contact finger is pressed to at least both ring-shaped surfaces.

An advantage of this arrangement is a reduced ohmic resistance and a reduced contact resistance as a parallel path for the current is established by the second ring-shaped surface of the contact arm. An additional advantage will be a lower rise of temperature of the electrical contact arrangement during the temperature rise typetest. This advantage can also be used to save some material of the contact arm and of a part of the contact arrangement. Further, there is an advantage under short-circuit conditions due to the doubled number of connection points. The risk of overheating of one connection point is reduced as the average current is lower for each connection point. The result will be a better performance during the short time withstand current type test.

In accordance with an exemplary embodiment, the other spring ring which surrounds the annulus arrangement of the contact fingers is provided to press the connection section of each contact finger to the first ring-shaped surface in the radial direction. The additional spring ring is provided to press the connection section of the contact fingers to the second ring-shaped surface, which runs in another direction than the first ring-shaped surface.

According to an exemplary embodiment of the present disclosure, the first ring-shaped surface and the second ring-shaped surface form an L-shaped groove on the distal end section of the contact arm. Such an L-shaped groove can be provided by adjacent sections of different diameters on the distal end of the contact arm.

In accordance with an exemplary embodiment, the L-shaped groove can, for example, correspond to a rectangular-shaped connection section of the contact finger, wherein the L-shaped groove corresponds with the other spring ring as well as with the additional spring ring for pressing the contact fingers against both ring-shaped surfaces.

A spring ring can be of any suitable kind to provide both the required force and the required elasticity of the contact arrangement. For example, a spiral spring is suitable for the first spring ring as well as for the additional spring ring. Furthermore, in accordance with an exemplary embodiment, it is possible to use a spring washer for the additional spring ring which generates an axially directed force to the contact fingers. In accordance with an exemplary embodiment, an additional screw element can be axially screwed into the front side of the contact arm in order to attach the additional spring ring to the second ring-shaped surface of the L-shaped groove.

According to an exemplary embodiment of the present disclosure, the first ring-shaped surface and the second ring-shaped surface form a V-shaped groove on the distal end section of the contact arm. The V-shaped groove can, for example, correspond to a curve-shaped connection section of the contact finger in order to establish a contact point on the first ring-shaped surface as well as on the second ring-shaped surface. An advantage of the V-shaped groove is that only one spring ring is necessary for pressing the contact fingers to the contact arm. Therefore, the V-shaped groove is radially directed in relation to the contact arm axis. Furthermore, an additional screw element is not necessary in this embodiment.

In accordance with an exemplary embodiment, the V-shaped groove can have a symmetrical cross-section. However, in accordance with another exemplary embodiment, it is also possible to provide the V-shaped groove with an asymmetrical cross-section. An asymmetrical cross-section can, for example, increase the portion of the force generated by the spring ring that presses the contact fingers to that side where the main current path is arranged in order to optimize the ohmic resistance and the contact resistance of the electrical contact arrangement.

The foregoing and other aspects of the disclosure will become apparent following the detailed description of exemplary embodiments of the present disclosure when considered in conjunction with the appended drawings. It is to be understood that dimensional or directional characterizations (e.g., right or left) used in the description of the exemplary embodiments below relate to the illustrations in the drawings, and that the present disclosure is not to be limited to such characterizations.

Figure 5:
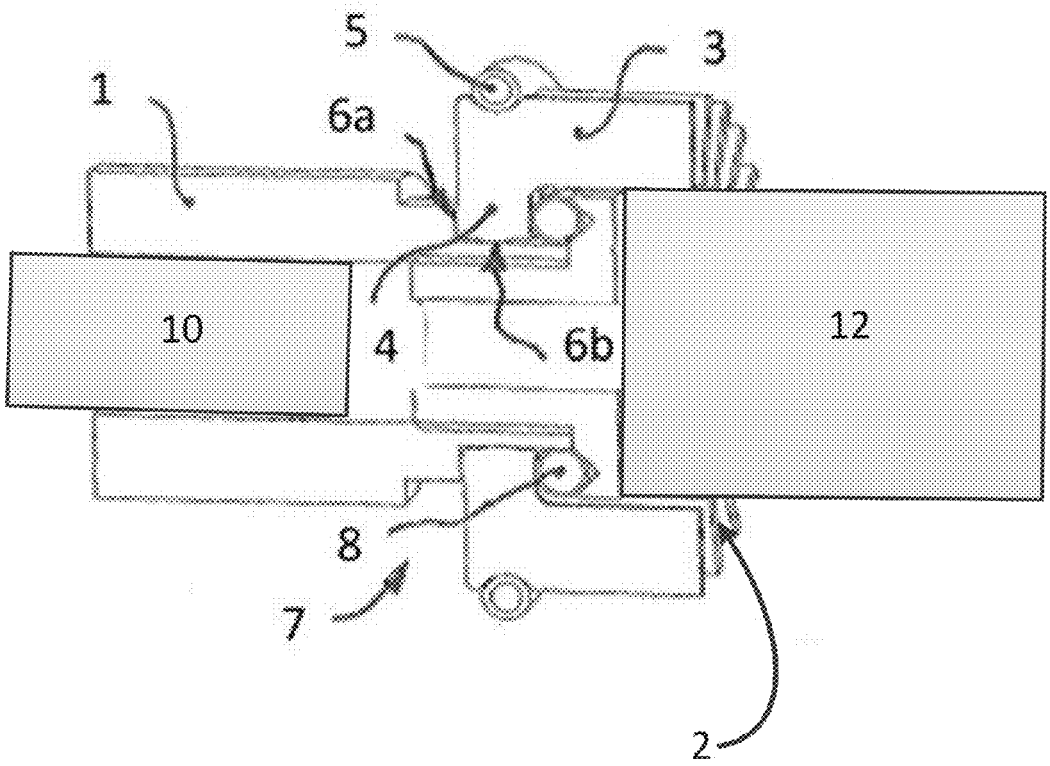
FIG. 5 is a perspective side view of an exemplary embodiment of an electrical contact arrangement of the present disclosure connected between at least one electrical pole part and a cable terminal by an electrical contact

FIG. 1 is a perspective side view of an exemplary embodiment of an electrical contact arrangement of the present disclosure in a L-groove version. The electrical contact arrangement as shown in FIG. 1 includes a contact arm 1, which is designed as a hollow cylinder composed of a material such as copper or aluminum material, for example. On its left side, the contact arm 1 is mechanically connected to a medium voltage circuit breaker pole part 10 (see FIG. 5, which shows the contact arm 1 mechanically connected to a pushbar terminal of a medium voltage circuit breaker pole part 10). On its right side, the contact arm 1 is provided with a distal end section 2 on which a circular shaped annulus arrangement is arranged. According to an exemplary embodiment, the annulus arrangement includes several axially and parallel directed contact fingers 3 for engaging a cable terminal 12, for example. Each contact finger 3 is pressed on the distal end section 2 of the contact arm 1 via a radially directed connection section 4 by a spring ring 5. The spring ring 5 is peripherally arranged around the contact fingers 3.

The distal end section 2 of the contact arm 1 includes a first ring-shaped surface **6*a* and an adjacent second ring-shaped surface 6*b* forming a L-shaped groove 7 on the distal end section 2 of the contact arm 1. The connection section 4 of each contact finger 3 is pressed to both ring-shaped surfaces 6*a* and 6*b*. For pressing the connection section to the first ring-shaped surface 6*a*, an additional spring ring 8 is provided which generates a spring force in the axial direction. The additional spring ring 8 is secured onto the front side of the contact arm 1 by a screw element 9 screwed into the hollow section of the tubular contact arm 1. In the exemplary embodiment of FIG. 1, the additional spring ring 8 as well as the other spring ring 5** are designed as spiral springs.

Figure 2:
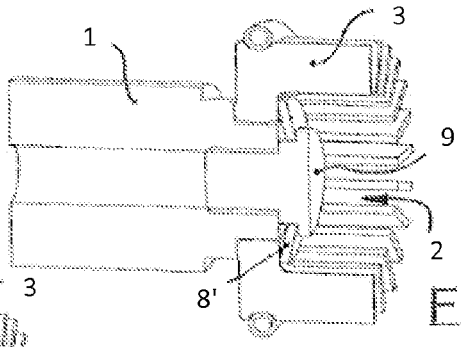
FIG. 2 is a perspective side view of an exemplary embodiment of an electrical contact arrangement of the present disclosure in an L-groove version.

FIG. 2 is a perspective side view of an exemplary embodiment of an electrical contact arrangement of the present disclosure in an L-groove version. According to the exemplary embodiment of FIG. 2, the additional spring ring 8' is designed as a washer spring for generating the axially directed pressing force to the contact fingers 3. The additional spring ring 8' is also fixed to the distal end section 2 of the contact arm 1 by a screw element 9.

Figure 3:
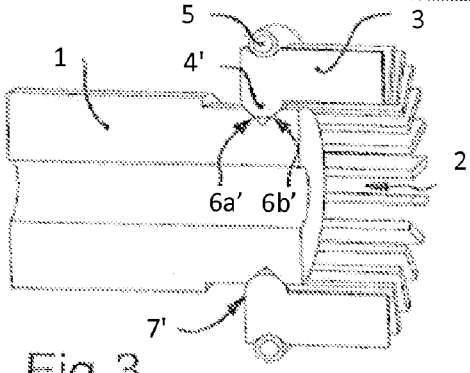
FIG. 3 is a perspective side view of an exemplary embodiment of an electrical contact arrangement of the present disclosure in a symmetrical V-groove version.

FIG. 3 is a perspective side view of an exemplary embodiment of an electrical contact arrangement of the present disclosure in a symmetrical V-groove version. In the exemplary embodiment of FIG. 3, a first ring-shaped surface **6*b*' and a second ring-shaped surface 6*a*' forms a V-shaped groove 7' on the distal end section 2 of the contact arm 1. Only one spring ring 5 is necessary in order to press each contact finger 3 into the V-shaped groove 7'. The V-shaped groove 7' corresponds to a curve-shaped connection section 4' of each contact finger 3**.

Figure 4:
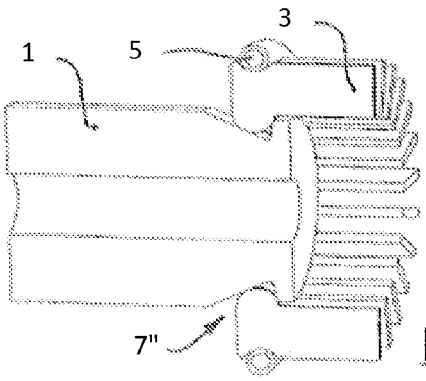
FIG. 4 is a perspective side view of an exemplary embodiment of an electrical arrangement of the present disclosure in an asymmetrical V-groove version.

FIG. 4 is a perspective side view of an exemplary embodiment of an electrical arrangement of the present disclosure in an asymmetrical V-groove version. According to the exemplary embodiment of FIG. 4, the V-shaped groove 7" is provided with an asymmetrical cross-section in order to increase the portion of the force generated by the other spring ring 5 to that side where main current path is disposed in order to optimize the ohmic resistance and the contact resistance of the electrical contact arrangement.

The contact fingers 3 will extend to the right side to another contact of the medium voltage switchgear panel, such as a connection to the busbar or to a cable, for example.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SYMBOLS

1 Contact arm
2 Distal end section

3 Contact finger
4 Connection section
5 Spring ring
6 Ring-shaped surface
7 L-shaped groove
8 Additional spring ring
9 Screw element

What is claimed is:

1. An electrical contact arrangement for medium to high voltage applications, the electrical contact arrangement comprising:

a contact arm having a distal end section;

a circular shaped annulus arrangement arranged on the distal end section of the contact arm, the annulus arrangement including a plurality of axially and parallel directed contact fingers; and a plurality of radially directed connection sections arranged to press a corresponding one of the plurality of contact fingers on the contact arm by a first spring ring which is peripherally arranged around the contact fingers, wherein the distal end section of the contact arm includes a first ring-shaped surface and an adjacent second ring-shaped surface, wherein the corresponding connection section of each contact finger is respectively pressed to both the first and second ring-shaped surfaces, and wherein the first ring-shaped surface and the second ring-shaped surface form a V-shaped groove on the distal end section of the contact arm.

2. The electrical contact arrangement according to claim 1, wherein the V-shaped groove corresponds to a curve-shaped connection section of each corresponding contact finger, respectively.

3. The electrical contact arrangement according to claim 1, wherein the V-shaped groove only corresponds with the first spring ring for pressing the contact fingers to the contact arm.

4. The electrical contact arrangement according to claim 1, wherein the V-shaped groove has an asymmetrical cross section.

5. The electrical contact arrangement according to claim 1, wherein the contact arm is composed of one of copper and aluminum.

6. An air insulated medium voltage circuit breaker comprising:

at least one electrical pole part which is electrically connected to at least one of a pushbar terminal and a cable terminal by an electrical contact arrangement according to claim 1.

7. The electrical contact arrangement according to claim 1, wherein the first ring-shaped surface and the second ring-shaped surface form an L-shaped groove on the distal end section of the contact arm.

8. The electrical contact arrangement according to claim 7, wherein the L-shaped groove corresponds to a rectangular-shaped connection section of each corresponding contact finger, respectively.

9. The electrical contact arrangement according to claim 1, wherein the first spring ring is an outer spring ring configured to press the corresponding connection sections of the contact fingers to the first ring-shaped surface, and wherein the electrical contact arrangement comprises a second spring ring configured to press the corresponding connection sections of the contact fingers to the second ring-shaped surface.

10. The electrical contact arrangement according to claim 9, wherein at least one of the first spring ring and the second spring ring is formed as a spiral spring.

11. The electrical contact arrangement according to claim 9, wherein the first ring-shaped surface and the second ring-shaped surface form an L-shaped groove on the distal end section of the contact arm, and wherein the L-shaped groove corresponds with the first spring ring and with the second spring ring for pressing the contact fingers to the contact arm.

12. The electrical contact arrangement according to claim 9, wherein the second spring ring is arranged as a washer spring for generating an axially directed pressing force to the contact fingers.

13. The electrical contact arrangement according to claim 9, wherein the first ring-shaped surface and the second ring-shaped surface form an L-shaped groove on the distal end section of the contact arm, and wherein the electrical contact arrangement includes a screw element axially screwed into a front side of the contact arm to attach the second spring ring to the second ring-shaped surface of the L-shaped groove.

14. The electrical contact arrangement according to claim 9, wherein the first ring-shaped surface and the second ring-shaped surface form an L-shaped groove on the distal end section of the contact arm.

15. The electrical contact arrangement according to claim 14, wherein the L-shaped groove corresponds to a rectangular-shaped connection section of each corresponding contact finger, respectively.

16. The electrical contact arrangement according to claim 14, wherein the L-shaped groove corresponds with the first spring ring and with the second spring ring for pressing the contact fingers to the contact arm.

17. The electrical contact arrangement according to claim 14, comprising:

a screw element axially screwed into a front side of the contact arm to attach the second spring ring to the second ring-shaped surface of the L-shaped groove.

* * * * *